United States Patent [19]

Huang

[11] Patent Number: 4,644,113

[45] Date of Patent: Feb. 17, 1987

[54] ELECTRIC SAFETY DEVICE

[76] Inventor: L. D. Huang, No. 105, San Ho Road, Sec. 4, Sanchung City, Taipei Hsien, Taiwan

[21] Appl. No.: 785,697

[22] Filed: Oct. 9, 1985

[51] Int. Cl.[4] ..... H01H 3/00

[52] U.S. Cl. ..... 200/17 R; 200/47; 200/50 C; 307/326

[58] Field of Search ..... 200/17 R, 17 A, 17 B, 200/18, 38 E, 158, 50 A, 50 C, 50 AA, 47; 307/326; 339/266 G; 340/649

[56] References Cited

U.S. PATENT DOCUMENTS 1,966,249 7/1934 Larson ..... 200/47

3,721,780 3/1973 Kelly et al. ..... 200/47

*Primary Examiner*—M. H. Paschall

*Assistant Examiner*—Morris Ginsburg

*Attorney, Agent, or Firm*—Sughrue, Mion, Zinn, Macpeak and Seas

[57] ABSTRACT

An electric safety device for controlling a power switch 8 and a grounding switch 9 of a high voltage electric device includes a motor 10, a threaded shaft 4 driven by the motor, a movable sleeve 5 on the threaded shaft for being driven by the motor to and fro, and a pair of rotary members 6, 7 each of which includes a wheel 62, 72 having a recess on its periphery, a rod 61, 71 axially extending from its center, and a U-shaped guide piece 63, 73 radially extending from the rod. The rods are parallel to one another and are disposed near the shaft perpendicularly, and the guide pieces are movable one after the other through 90° when pushed by the sleeve to cause the rods and the wheels to rotate. The periphery of one of the wheels cams the power switch off and the periphery of the other wheel thereafter releases the grounding switch when they rotate to safely enable maintenance work.

6 Claims, 2 Drawing Figures

ELECTRIC SAFETY DEVICE

BACKGROUND OF THE INVENTION

The present invention relates to an improved electric safety device particularly concerning a device for sequentially controlling a power switch and a grounding switch of a high voltage electric device to render the user safe from a high voltage shock.

Electric power generated from a power station is distributed to consumers by means of high voltage current sent first through transmission lines to substations, then distributed to consumers. When a fault or problem occurs at a consumer distribution line, the maintenance person has to switch off the power source switch manually and then ground the switch for safety in processing his maintenance work. Such kind of manual switching off of the power source and grounding is dangerous if the remaining voltage is high enough and there may still remain enough voltage to harm or kill the maintenance person even though the power source has been switched off.

SUMMARY OF THE INVENTION

With the above disadvantages in mind, the general object of the invention is to provide an improved electric safety device which is simple in construction and which will overcome the deficiencies and disadvantages of the prior arrangements.

An object of the invention is to provide a reliable and practical electric safety device for switching off the high voltage source switches and grounding to prevent potentially fatal accidents to users.

A further object of the invention is to provide a novel and simple arrangement of an electric safety device which can be arranged to be controlled by a computer or remote controller automatically to let the maintainer proceed with his maintenance work at a distance.

In order to achieve the aforesaid objects as well as other incidental objects and advantages, the invention includes a motor which is controlled by a computer or a remote controller, a threaded shaft driven by the motor, and a movable member sleeved on the threaded shaft for being driven by the motor to and fro along the threaded shaft.

The invention further includes a pair of rotary members each of which includes a wheel having a recess on its periphery, a rod axially extending from its center, and a guide piece radially extending from the rod. The recesses of the wheels are set in such an arrangement that the recess of one of the wheels lags behind or leads the recess of the other wheel by 90 degrees. The guide piece is a U-shaped member wrapped around and clamping the rod and having two arms extending radially close to the shaft where the arms are capable of rotating forward or backward by 90 degrees when the movable member is pushed. Each recess is in the shape of an arc, and the center of each recess is in a position spaced from the arms of the associated U-shaped guide piece by 45 degrees.

The rods are parallel to one another and are disposed perpendicularly near the shaft. The guide pieces are movable one after the other within a certain angular range when pushed by the movable member, to cause the rods and the wheels to rotate and the periphery of one of the wheels to cam the power switch and the periphery of the other wheel to cam the grounding switch when the wheels rotate so that the user need not switch off the power source manually and is saved from receiving a shock or being harmed by high voltage.

BRIEF DESCRIPTION OF THE DRAWINGS

Other and further objects and advantages of this invention will become apparent to those skilled in the art from a consideration of the following detailed description of the preferred embodiments with reference to the accompanying drawings, wherein.

DETAILED DESCRIPTION OF THE PREFERRED EMBODIMENT

The following is a detailed description of the best presently contemplated embodiment of the invention. This description is not to be taken in a limiting sense, but is made merely for the purpose of illustrating the general principles of the invention.

Figure 1:
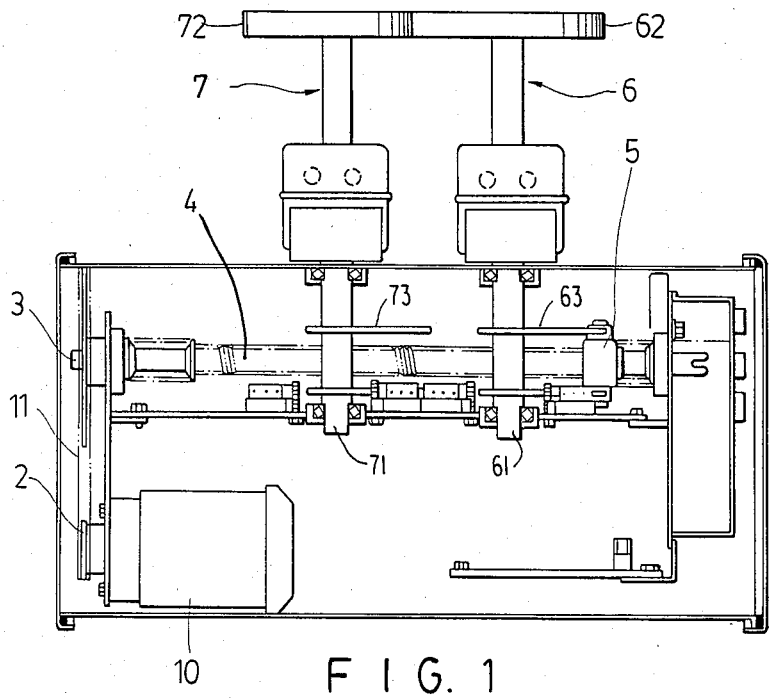
FIG. 1 is a schematic view showing the inner arrangement of an embodiment of the improved electric safety device according to the present invention.
Figure 2:
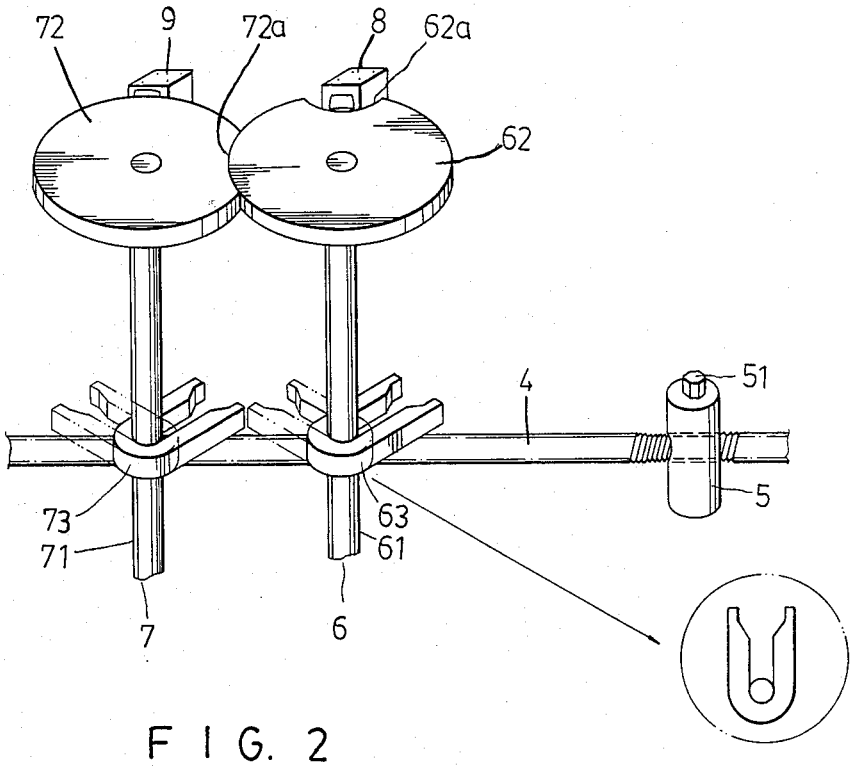
FIG. 2 is a perspective view of the arrangement of the rotary members and the movable member in FIG. 1 according to the present invention.

Referring to FIG. 1 and FIG. 2, the invention includes a motor 10 which a small gear 2, a threaded shaft 4 with a larger gear 3 at its end driven by the motor 10 by a chain 11 which engages with the small gear 2 and the larger gear 3, and a movable member 5 having a protrusion 51 sleeved on the threaded shaft 4 for being driven by the motor 10 to and fro along the threaded shaft 4.

The invention further includes a pair of rotary members 6, 7 each of which includes a wheel 62 or 72 having a recess **62*a* or 72*a* on its periphery, a rod 61 or 71 axially extending from the center of the wheel, and a U-shaped guide piece 63 or 73 radially extending from the rod 61 or 71. The rods 61, 71 are parallel to one another and are disposed perpendicularly near the shaft 4**.

The recesses **62*a*, 72*a* of the wheels 62, 72 are set in such an arrangement that the recess 72*a* of the wheel 72 lags behind the recess 62*a* of the wheel 62 by 90 degrees and the recesses 62*a*, 72*a* are in the shape of an arc. The center of each recess 62*a*, 72*a* is in a position spaced from the radial axis of its associated U-shaped guide piece 63, 73 by 45 degrees. The U-shaped guide pieces 63, 73 are clamped to the rods 61, 71 and have two arms extending radially close to the shaft 4; the arms are capable of rotating forward or backward by 90 degrees when the protrusion 51 of the movable member 5 pushes the guide pieces 63, 73. The wheels 62, 72 have the same radius to allow precision in the rotating function of the recesses 62*a*, 72*a* precisely and the wheels 62, 72 are adjacent to one another. The periphery of one of the wheels 62, 72 nests in and thus passes through the recess 62*a* or 72*a*** of the other wheel when the wheels rotate.

When the motor 10 is switched on, the movable member 5 on the shaft 4 moves into the guide pieces 63, 73 one after the other. The protrusion 51 of the movable member 5 first engages with the two arms of the guide piece 63 and causes the rod 61 and the wheel 62 to rotate through 90°, the recess **62*a* moving past the power source switch 8 so the periphery of the wheel 62 cams the power source to switch it off. The wheel 72 necessarily remains motionless when the wheel 62 is rotating due to the periphery of the wheel 62 nesting in the recess 72***a*. The movable member 5 continues to move along toward the guide piece 73. The protrusion 51 of the movable member 5 then leaves the guide piece 63 and engages with the guide piece 73, at which point the two recesses 62*a* and 72*a* are complementarily or oppositely aligned to thus "unlock" the wheel 72, causing the rod 71 and the wheel 72 to rotate until the recess 72*a* reaches and releases the grounding switch 9, thus grounding the high voltage line. After the user switches off the power source and grounds the high voltage, it is safe for him to carry on his maintenance work.

The motor can be controlled also by a computer or a remote controller so that the user can operate the electric safety device at a distance. The invention also can be arranged to use a plurality rotary members for controlling more switches.

While this invention has been described with what are presently considered to be the most practical and preferred embodiments, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass all such modifications and equivalent structures.

I claim:

1. An improved electric safety device for sequentially controlling a power switch (8) and a grounding switch (9) of a high voltage electric device, comprising:

(a) a motor (10);

(b) a threaded shaft (4) driven by said motor;

(c) a movable sleeve threaded on said shaft to be driven by said motor to and fro along said shaft;

(d) a pair of rotary members (6, 7) each including a wheel (62, 72) having a recess (62*a*, 72*a*) on its periphery, a rod (61, 71) axially extending from a center of the wheel, and a guide piece (63, 73) radially extending from said rod, and (e) a power switch and a grounding switch individually mounted proximate and associated with the respective rotary member wheels, (f) said rods being parallel to one another and disposed near said shaft perpendicularly, each of said guide pieces being individually and independently rotatably movable one after the other within a predetermined angular range when engaged and pushed by said sleeve to cause said rods and said wheels to rotate, the periphery of one of said wheels actuating the power switch and the periphery of the the other wheel actuating the grounding switch as they rotate.

2. An improved electric safety device as claimed in claim 1, wherein said recesses of said wheels are disposed such that said recess of one of said wheels lags behind said recess of the other wheel by 90 degrees when said wheels are at rest.

3. An improved electric safety device as claimed in claim 1, wherein each guide piece is a U-shaped member wrapped around and clamping an associated rod, having two arms extending radially close to said shaft, said arms being capable of rotating forward or backward by 90 degrees when pushed by said sleeve.

4. An improved electric safety device as claimed in claim 1, in which each recess is in the shape of an arc, and a center of each recess is disposed in a position spaced from a radial axis of an associated U-shaped member by 45 degrees.

5. An improved electric safety device as claimed in claim 1, wherein said wheels have a same radius.

6. An improved electric safety device as claimed in claim 1, wherein said wheels are adjacent to one another and the periphery of one of said wheels nests in and passes through said recess of another one of said wheels when said wheels rotate, and wherein when said one of said wheels rotates, said another one of said wheels remains motionless.

* * * * *